US009221258B2

(12) United States Patent
Akama et al.

(10) Patent No.: US 9,221,258 B2
(45) Date of Patent: Dec. 29, 2015

(54) LIQUID EJECTION HEAD, LIQUID EJECTION DEVICE AND METHOD OF ELECTRICALLY CONNECTING LIQUID EJECTION HEAD AND LIQUID CONTAINER

(71) Applicant: CANON KABUSHIKI KAISHA, Tokyo (JP)

(72) Inventors: Yuichiro Akama, Tokyo (JP); Kiyomitsu Kudo, Machida (JP); Satoshi Kimura, Kawasaki (JP); Tomotsugu Kuroda, Yokohama (JP); Kyosuke Toda, Kawasaki (JP); Naoko Tsujiuchi, Kawasaki (JP); Sayaka Seki, Tokyo (JP); Yosuke Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/719,614

(22) Filed: May 22, 2015

(65) Prior Publication Data

US 2015/0343771 A1 Dec. 3, 2015

(30) Foreign Application Priority Data

May 30, 2014 (JP) ..... 2014-112194
Apr. 27, 2015 (JP) ..... 2015-090381

(51) Int. Cl.
*B41J 2/14* (2006.01)

(52) U.S. Cl.
CPC ..... *B41J 2/1433* (2013.01); *B41J 2002/14491* (2013.01)

(58) Field of Classification Search
CPC ..... B41J 2/14024; B41J 2/16505; B41J 2/16538; B41J 2/17553; B41J 2/17513; B41J 2/1752; B41J 2/17526; B41J 2/16541
USPC ..... 347/37, 50, 86
See application file for complete search history.

(56) References Cited

U.S. PATENT DOCUMENTS

| | | | | |
|---|---|---|---|---|
| 6,062,680 | A | 5/2000 | Yoshihira et al. | |
| 6,113,224 | A | 9/2000 | Sugama et al. | |
| 6,154,237 | A | 11/2000 | Kashino et al. | |
| 6,206,508 | B1 | 3/2001 | Asakawa et al. | |
| 6,252,616 | B1 | 6/2001 | Okazaki et al. | |
| 6,293,652 | B1 * | 9/2001 | Arashima et al. | 347/49 |
| 6,378,992 | B2 | 4/2002 | Kudo et al. | |
| 6,447,103 | B1 | 9/2002 | Sugama et al. | |
| 6,582,065 | B1 | 6/2003 | Okazaki et al. | |
| 6,595,626 | B2 | 7/2003 | Kudo et al. | |
| 6,652,076 | B2 | 11/2003 | Nakata et al. | |

(Continued)

FOREIGN PATENT DOCUMENTS

JP 2013-540066 A 10/2013

OTHER PUBLICATIONS

Co-pending, unpublished U.S. Appl. No. 14/721,246 to Kyosuke et al., dated May 26, 2015.

*Primary Examiner* — An Do
(74) *Attorney, Agent, or Firm* — Fitzpatrick, Cella, Harper & Scinto

(57) ABSTRACT

A liquid ejection head includes a recording element substrate for ejecting liquid, a mounting section to be loaded with a liquid container, and a connector equipped with a contact spring capable of expanding and contracting in an axial direction to be brought into contact with a contact substrate provided on the liquid container. The axial direction of the contact spring is inclined relative to the direction of loading the liquid container in the mounting section.

20 Claims, 5 Drawing Sheets

(56) References Cited

U.S. PATENT DOCUMENTS

| | | | | |
|---|---|---|---|---|
| 6,755,506 | B2 | 6/2004 | Nishikori et al. | |
| 7,416,290 | B2 * | 8/2008 | Hattori et al. | 347/86 |
| 7,938,511 | B2 | 5/2011 | Tomizawa et al. | |
| 8,052,251 | B2 | 11/2011 | Kudo et al. | |
| 8,100,505 | B2 | 1/2012 | Kuroda et al. | |
| 8,246,146 | B2 | 8/2012 | Toda et al. | |
| 8,474,960 | B1 | 7/2013 | Harvey et al. | |
| 8,567,908 | B2 | 10/2013 | Kudo et al. | |
| 8,931,888 | B2 * | 1/2015 | Kanbe et al. | 347/86 |
| 8,998,375 | B2 | 4/2015 | Amma et al. | |
| 2014/0307027 | A1 | 10/2014 | Toda et al. | |

* cited by examiner

LIQUID EJECTION HEAD, LIQUID EJECTION DEVICE AND METHOD OF ELECTRICALLY CONNECTING LIQUID EJECTION HEAD AND LIQUID CONTAINER

BACKGROUND OF THE INVENTION

1. Field of the Invention

The present invention relates to a liquid ejection head for ejecting liquid, a liquid ejection device and a method of electrically connecting a liquid ejection head and a liquid container that the liquid ejection device includes.

2. Description of the Related Art

Various methods of electrically connecting a liquid container and a liquid ejection head arranged in a liquid ejection device have been proposed to date for the purpose of supplying liquid from the liquid container to the liquid ejection head. Japanese Patent Application Laid-Open No. 2013-540066 discloses a technique of supplying liquid from a liquid container to a liquid ejection head by sticking a hollow joint needle arranged on the liquid ejection head into the liquid container. Japanese Patent Application Laid-Open No. 2013-540066 also discloses a technique of electrically connecting a liquid container to a liquid ejection head by bringing the contact substrate arranged in the liquid container into contact with the corresponding connector arranged in the liquid ejection head. Information on the liquid stored in the liquid container is recorded in the contact substrate. The information is transmitted to the connection substrate arranged in the liquid ejection head by way of the connector.

With the latter technique described in Japanese Patent Application Laid-Open No. 2013-540066, the connector is inevitably arranged on a lateral surface of the liquid ejection head because the contact substrate is arranged on a lateral surface of the liquid container. The connection substrate that receives the information recorded in the contact substrate by way of the connector is normally arranged on the rear surface of the liquid ejection head for the purpose of communicating with the main body of the liquid ejection device. Therefore, the connector and the connection substrate cannot be connected to each other directly and hence an additional connection/wiring means such as a flexible cable needs to be provided. Then, as a result, the overall configuration of the liquid ejection device will become a complex one. Furthermore, there is a newly found fact that the electrical connection between the liquid ejection head and the liquid container is adversely affected by oxidization of the contact area of the contact substrate arranged in the liquid container.

SUMMARY OF THE INVENTION

In an aspect of the present invention, there is provided a liquid ejection device including: a liquid ejection head for ejecting liquid; and a liquid container storing liquid to be supplied to the liquid ejection head and adapted to be loaded in the liquid ejection head; the liquid container having a contact substrate arranged on the surface thereof located close to the liquid ejection head at the time of being loaded in the liquid ejection head; the liquid ejection head having a connector arranged at a position located vis-à-vis the contact substrate of the loaded liquid container and a connection substrate to be electrically connected to the connector; the connector including a contact spring having a front end section contacting the contact substrate of the loaded liquid container and a rear end section contacting the connection substrate, the surface of the contact substrate being inclined relative to the axial direction of the contact springs so as to displace the front end section of the contact spring in a state of being held in contact with the surface of the contact substrate during the operation of loading the liquid container in the liquid ejection head.

In another aspect of the present invention, there is provided a method of electrically connecting a liquid ejection head for ejecting liquid and a liquid container storing liquid to be supplied to the liquid ejection head after being loaded in the liquid ejection head; the liquid container having a contact substrate arranged on the surface thereof located close to the liquid ejection head at the time of being loaded in the liquid ejection head; the liquid ejection head having a connector arranged at a position located vis-à-vis the contact substrate of the liquid container at the time of being loaded in the liquid ejection head and a connection substrate electrically connected to the connector; the connector including contact springs having a rear end section contacting the connection substrate and a front end section designed to be brought into contact with the contact substrate; by moving the liquid container toward the liquid ejection head while keeping the surface of the contact substrate in a state of being inclined relative to the axis direction of the contact spring so as to displace the front end section of the contact spring along the surface of the contact substrate while being held in contact with the surface of the contact substrate.

In still another aspect of the present invention, there is provided a liquid ejection head including: a recording element substrate for ejecting liquid; a mounting section to be loaded with a liquid container; and a connector equipped with a contact spring to be brought into contact with the contact substrate provided on the liquid container; the axial direction of the contact spring being inclined relative to the direction of loading the liquid container in the mounting section.

Further features of the present invention will become apparent from the following description of exemplary embodiments with reference to the attached drawings.

DESCRIPTION OF THE EMBODIMENTS

Figure 1A:
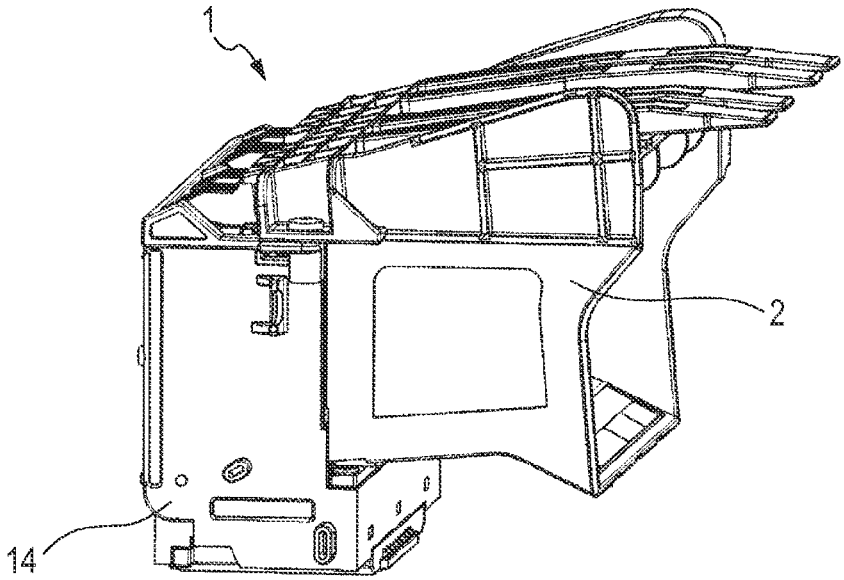
FIGS. 1A and 1B are schematic perspective views of a liquid ejection head to be arranged in a liquid ejection device according to the present invention.

Now, an embodiment of the present invention will be described below. The liquid ejection device of this embodiment includes a liquid ejection head for ejecting liquid and liquid containers containing in the inside thereof liquid to be supplied to the liquid ejection head. FIG. 1A is a schematic perspective view of the liquid ejection head as seen from a lateral side thereof and FIG. 1B is a schematic perspective view of the liquid ejection head as seen from the rear side of thereof.

Figure 1B:
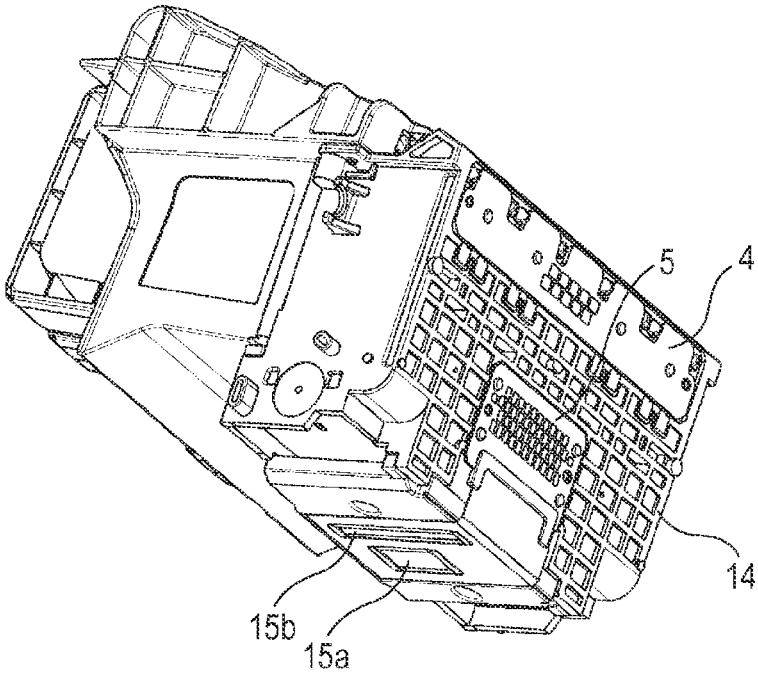

The liquid ejection head 1 illustrated in FIGS. 1A and 1B has a mounting section to be loaded with the liquid containers (not-illustrated in FIGS. 1A and 1B), a cover 2 fixed to the liquid ejection head and a housing 14, which housing 14 is provided with an ejection section that has recording element substrates 15*a* and 15*b*. The front side of the cover 2 is wide open so as to allow liquid containers to be inserted therein. The cover 2 is provided with a rib (not illustrated) in the inside thereof and the rib operates as a guide when the liquid containers are loaded in the cover 2. The front side of the top surface of the cover 2 is upwardly inclined relative to the rear side of the top surface. In this embodiment, a total of four liquid containers can be loaded in the liquid ejection head 1 to supply four color inks of CMYK (cyan, magenta, yellow and black).

As illustrated in FIG. 1B, a connection substrate and a connection substrate 5 are arranged on the rear surface of the liquid ejection head 1. When the liquid ejection head 1 is fixed to the main body (not illustrated) of a liquid ejection device, the connection substrates 4 and 5 are electrically connected to the main body. Information on the liquids stored in the liquid containers (inks in the case of this embodiment) and so on is exchanged between the connection substrate 4 and the main body. On the other hand, information on the recording operation to be conducted by the liquid ejection head 1 is exchanged between the connection substrate 5 and the main body and the liquid ejection head is driven to operate according to the exchanged information.

Figure 2A:
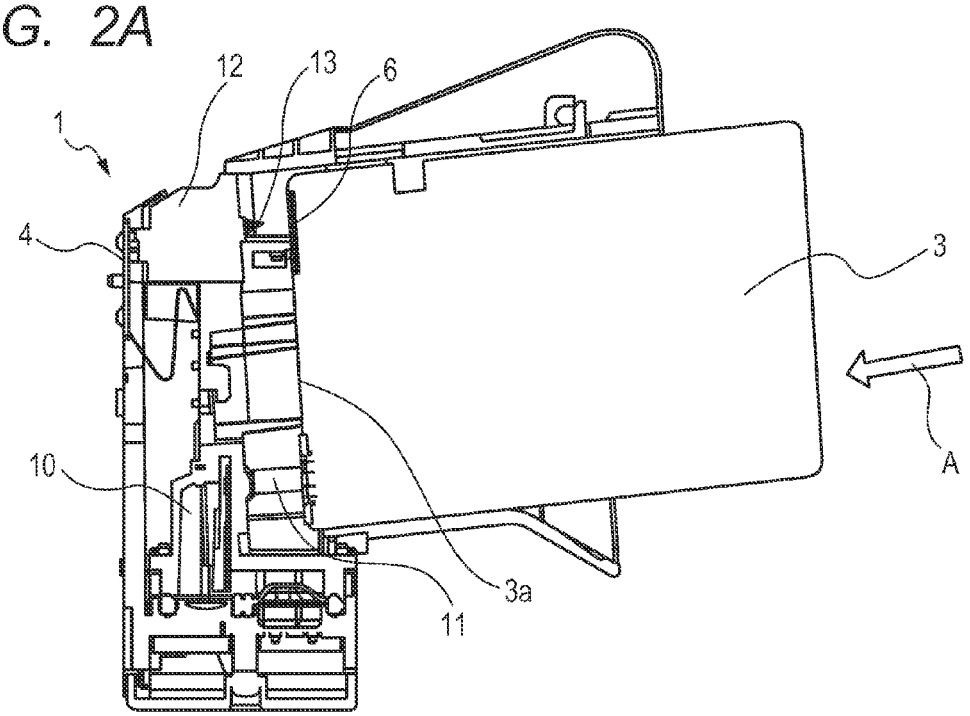
FIGS. 2A and 2B are schematic cross-sectional views of the liquid ejection head illustrated in FIGS. 1A and 1B, illustrating how a liquid container is loaded in the liquid ejection head.
Figure 2B:
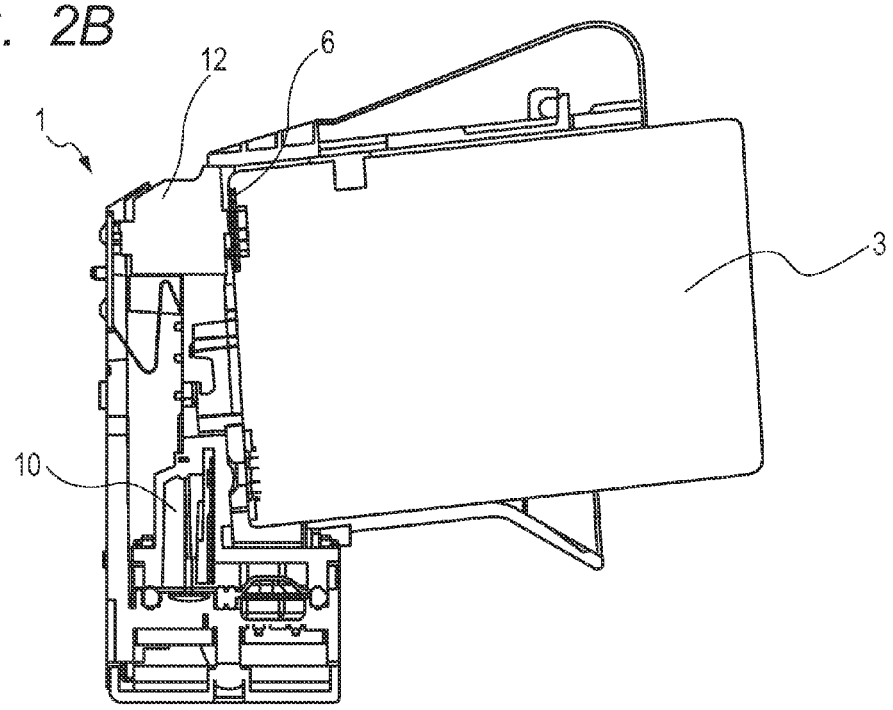

FIGS. 2A and 2B are schematic cross-sectional views of the liquid ejection head and a liquid container, illustrating how the liquid container is loaded in the liquid ejection head. More specifically, FIG. 2A illustrates a state where the operation of loading the liquid container is in progress and FIG. 2B illustrates a state where the operation of loading the liquid container has been completed.

As illustrated in FIG. 2A, the liquid ejection head 1 includes a joint needle 11 for supplying ink from the liquid container to the recording element substrates and a liquid chamber 10 that communicates with the joint needle 11. A supply port is formed at a lateral surface of the liquid container 3. The supply port is opened at a position located vis-à-vis the joint needle 11 and covered by a piece of film. The film is broken by the joint needle 11 when the liquid container 3 is inserted into the liquid ejection head 1. The joint needle 11 has a hollow profile and the liquid stored in the liquid container 3 is supplied to the liquid chamber 10 by way of the joint needle 11.

A contact substrate 6 (memory substrate) that is mounted by an IC chip is arranged at an upper part of the front surface 3*a* of the liquid container 3 (the front surface as viewed from the liquid ejection head 1 when the liquid container 3 is loaded in the liquid ejection head 1). A plurality of gold-plated contacts 16 (FIGS. 4A and 4B) is arranged on the front surface of the contact substrate 6. Information on the liquid stored in the liquid container 3 (including information on the color, the remaining amount and so on of the liquid) is recorded in the IC chip. A connector 12 is arranged in the liquid ejection head 1 at a position located vis-à-vis the contact substrate 6. The connector 12 is provided with contact springs 13, the number of which is the same as the number of the contacts 16. The contact springs 13 extend through the housing of the connector 12 all the way from the front surface to the rear surface thereof. The connection substrate 4 contacts the rear ends of the contact springs 13 projecting out from the rear surface of the housing. More specifically, the rear ends of the contact springs 13 are located at the rear surface of the connection substrate 4 (the surface disposed opposite to the connector 12) and held in contact with the respective gold-plated contacts arranged on the connection substrate 4. This embodiment is designed such that two springs are connected to each other in the connector to realize a single contact spring. In other words, this embodiment is designed such that the IC chip of the liquid container 3 and the connection substrate 4 are connected to each other by way of the connector 12.

While each of the contact springs 13 is realized by two springs that are brought into contact with each other under pressure in the connector 12, each of the contact springs 13 may alternatively be formed by a single spring. In such an instance, each of the contact springs is connected at an end thereof to the connection substrate 4 arranged in the liquid ejection head and connectable at the other end 13*a* (FIG. 5A) thereof to the contact substrate 6 arranged on the liquid container 3. Each of the contact springs is forcibly put into a slit formed in the connector 12 under pressure and fixed at a middle part between the opposite ends of the contact spring.

Figure 3A:
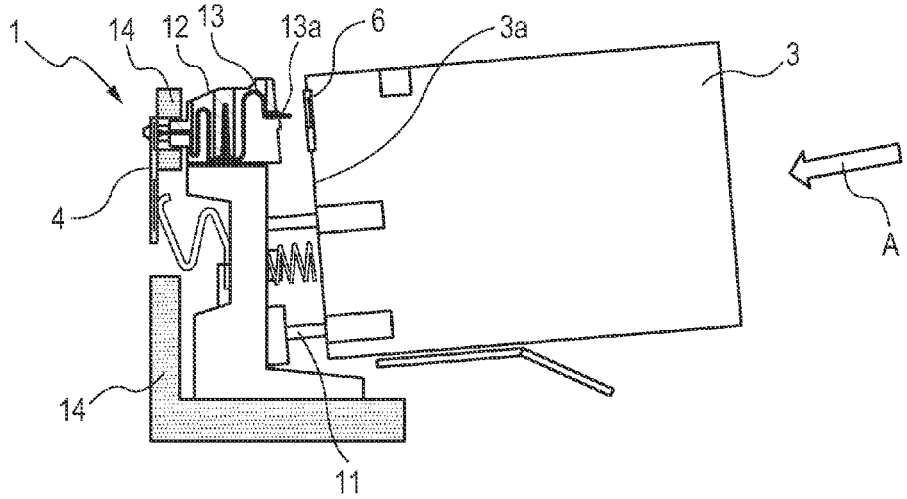
FIGS. 3A, 3B and 3C are schematic cross-sectional views of the liquid ejection head illustrated in FIGS. 1A and 1B, illustrating different states of the contact spring of the liquid ejection head that can be observed when a liquid container is loaded in the liquid ejection head.
Figure 3B:
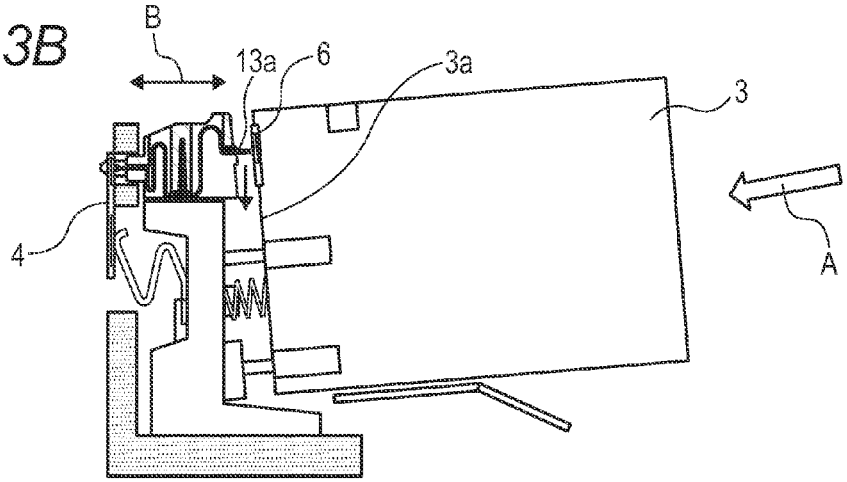
Figure 3C:
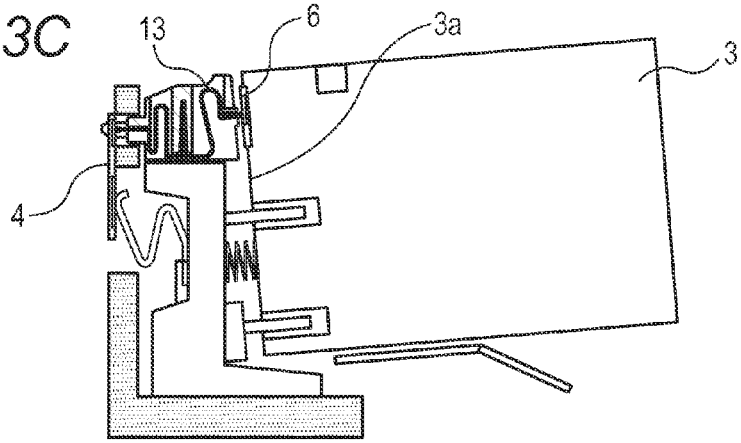

FIGS. 3A through 3C are schematic cross-sectional views of one of the contact springs in an operation of loading the liquid container in the liquid ejection head. The condition of the contact spring 13 in an operation of loading the liquid container 3 in the liquid ejection head 1 will be described below by referring to FIGS. 3A through 3C.

FIG. 3A illustrates a state where the front end section 13*a* of the contact spring 13 is not brought into contact with the contact substrate 6 of the liquid container yet. In this state, the joint needle 11 at the side of the liquid ejection head has already started to be inserted into the supply port of the liquid container. In this embodiment, the connector 12 is fixed to one of the opposite surfaces of the housing 14, while the connection substrate 4 is fixed to the other surface of the housing 14 and the contact springs 13 are connected to the rear surface of the connection substrate 4 by way of the respective apertures formed in the housing 14.

Figure 5A:
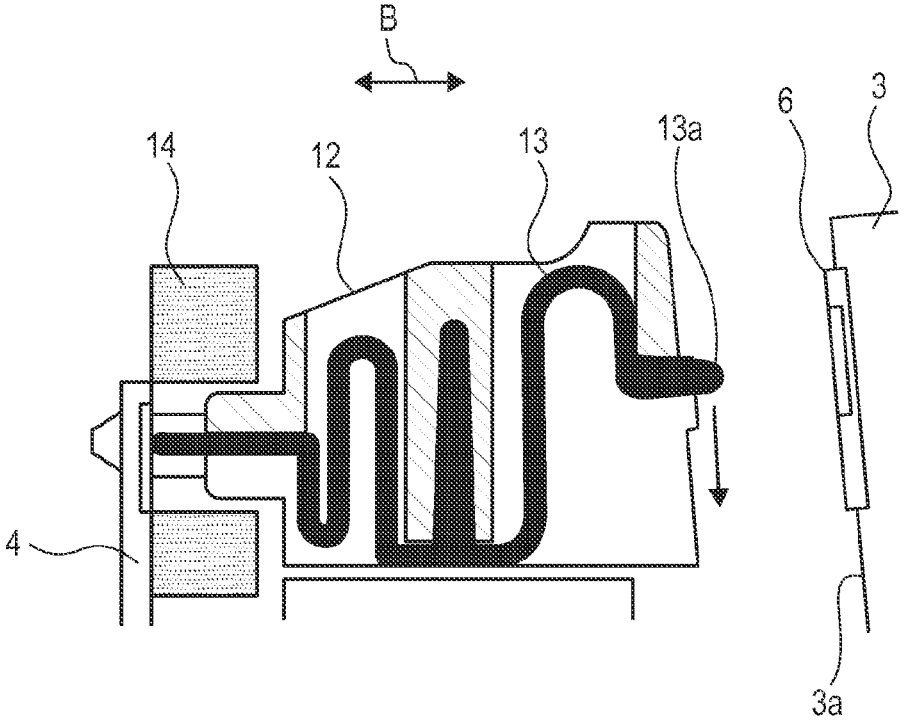
FIGS. 5A and 5B are schematic cross-sectional views of the connector illustrated in FIGS. 4A and 4B.

As the liquid container 3 is inserted in the loading direction A in the state illustrated in FIG. 3A, the front ends 13*a* of the contact springs 13 are brought into contact with the surface of the contact substrate 6 of the liquid container 3 as illustrated in FIG. 3B. At this time, the liquid container 3 is inserted into the liquid ejection head 1 in an attitude where the front surface 3*a* thereof is inclined forwardly relative to the axial direction of the contact springs 13 (see arrow B in FIG. 3B). Note that the axial direction of the contact springs 13 is the direction in which each of the contact springs 13 is displaced when the contact spring 13 is subjected to external force. When two springs are arranged in the connector 2 for a single contact spring 13 as in the case of this embodiment, the expression of a forwardly inclined attitude as used above refers to an instance where the axial direction of the spring that is brought into contact with the liquid container and the direction in which the liquid container is inserted are inclined relative to each other. Then, as the liquid container 3 is inserted further in the loading direction A, the front end section 13*a* of the contact spring 13 is pressed against the contact substrate 13 and displaced downward while the front end section 13*a* is held in contact with the contact substrate 6. In other words, the front end 13*a* of the contact spring 13 is displaced along the surface of the contact substrate 6 in a state of being held in contact with the front surface of the contact substrate 6. At this time, in the state illustrated in FIG. 3A, any vertically upward displacement of the front end section 13*a* of the contact spring 13 is restricted by a restricting section of the housing of the connector 12. Additionally, the contact spring 13 is upwardly bent at a section thereof that is extending from and directly connected to the front end section 13*a* (FIG. 5A). In other words, the contact spring 13 has a bent section between the front end section 13*a* and a fixing section thereof that is fixed to the connector. Furthermore, the connector 12 has a restricting section for restricting the part of the contact spring 13 located between the front end section 13*a* and the bent section. Because of these arrangements, as the liquid container is inserted (in the direction A) from obliquely upward toward obliquely downward relative to the axial direction B and when the front end section 13*a* of the contact spring 13 is pressed against the contact substrate 6 of the liquid container 3, the downward displacement of the front end section 13*a* is boosted. Then, as a result, if the contact area of the contact substrate 6 has been oxidized, the liquid container 3 is electrically brought into contact with the liquid ejection head 1 in a state where the oxidized part of the contact substrate is scraped off by the front end section 13*a* of the contact spring 13. Thus, the liquid container 3 can reliably be electrically connected to the liquid ejection head 1. Particularly, since the front end section 13*a* of each of the contact springs 13 is formed so as to be pointed just like a needle, the oxidized part, if any, of the contact substrate 6 can easily be removed by the front end section 13*a* of the corresponding contact spring 13 to make the electrical contact between the liquid container 3 and the liquid ejection head 1 even more reliable. When each of the contact springs 13 is fixed to the connector 12 at a part of the contact spring 13 as in the case of this embodiment, any undesired movement of the contact spring itself is restricted and hence the front end section 13*a* of the contact spring 13 can reliably and effectively scrape off the oxidized part, if any, of the contact substrate 6. While the liquid container is inserted into the liquid ejection head from obliquely upward toward obliquely downward relative to the axial direction of the contact springs 13 in the above description of the embodiment, the direction in which the liquid container is inserted into the liquid ejection head is by no means limited to the above-described one. The present invention is applicable to any arrangement for the angle of insertion of a liquid container in a liquid ejection head so long as the axial direction of the contact springs is inclined relative to the direction of insertion of liquid containers.

Besides, in this embodiment, the connector 12 is arranged at a position where the connector 12 is disposed opposite relative to both the contact substrate 6 of the liquid container 3 and the connection substrate 4 of the liquid ejection head 1. With this arrangement, then, the connector 12 can directly be connected to the connection substrate 4 to allow the entire wiring arrangement of the liquid ejection head 1 to be a simple and compact one.

Furthermore, in this embodiment, four connectors are provided to correspond respectively to the four liquid containers 3 to be loaded in the liquid ejection head 1. In other words, the number of connectors 12 provided in the liquid ejection head is the same as the number of liquid containers 3 to be loaded in the liquid ejection head. Each of the connectors is electrically connected to the connection substrate 4. As a connector 12 is provided to correspond to a single liquid container, the contact springs 13 of the connector 12 that corresponds to a liquid container already loaded in the liquid ejection head 1 are less liable to be deformed by the external force that arises when another liquid container 3 is loaded. Therefore, the positional accuracy of the points of connection between the contact springs 13 of each of the connectors and the contact substrate 6 of the liquid container to be loaded in the liquid ejection head 1 at the position corresponding to the connector is ensured.

While the connectors 12 are fixed to the housing 14 in this embodiment, the present invention is by no means limited to such an arrangement. For example, the connectors 12 may alternatively be fitted to the housing 14 by means of a snap fit joint structure. An exemplar connector having a snap fit joint structure will be described below.

Figure 4A:
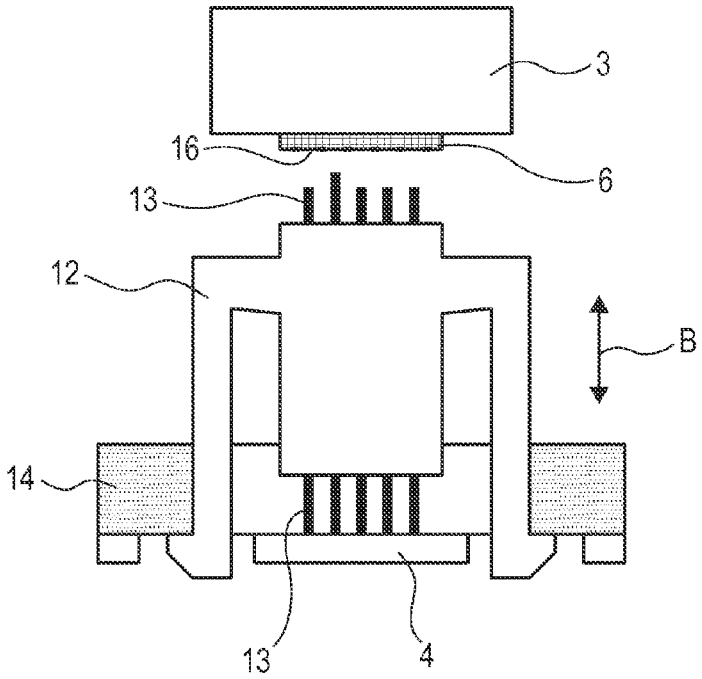
FIGS. 4A and 4B are schematic plan views of a connector having a snap fit joint structure.
Figure 4B:
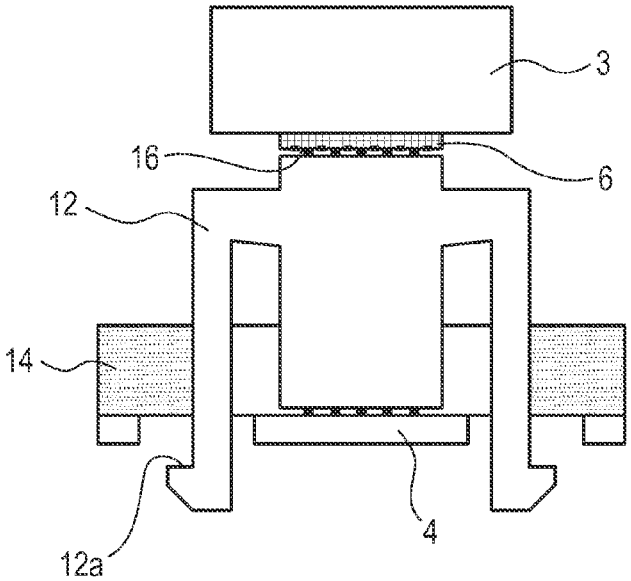

FIGS. 4A and 4B are schematic plan views of a connector having a snap fit joint structure. FIG. 4A illustrates a state where the contact springs 13 of the connector 12 have not yet been brought into contact with the contact substrate 6 of the liquid container 3 that is being loaded in the liquid ejection head 1 and FIG. 4B illustrates a state where the contact springs 13 of the connector 12 have already been brought into contact with the contact substrate 6. Note that the longest one of the plurality of contact springs illustrated in FIG. 4A is provided so as to be grounded.

Figure 5B:
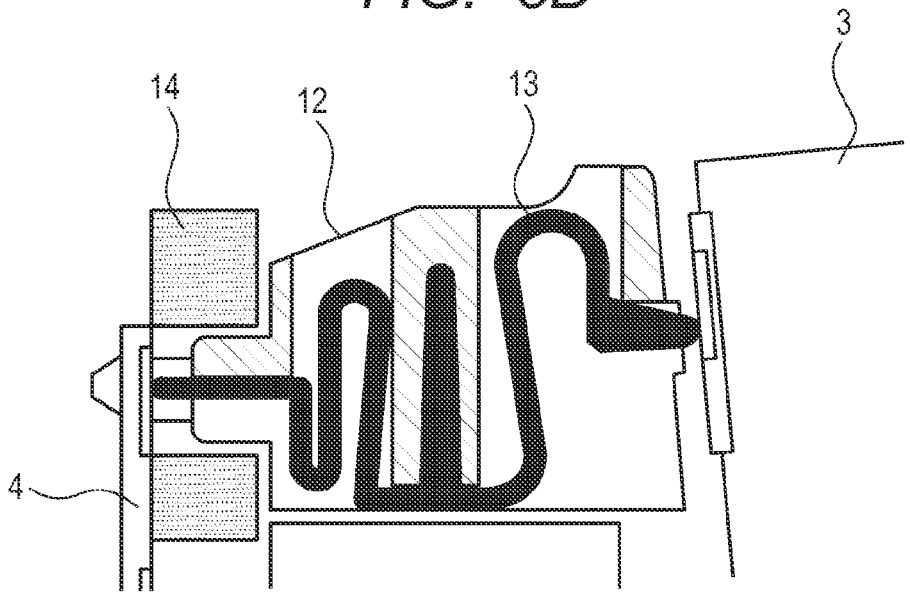

FIGS. 5A and 5B are schematic cross-sectional views of the connector illustrated in FIGS. 4A and 4B. Similar to FIGS. 4A and 4B, FIG. 5A illustrates a state where the contact springs 13 of the connector 12 have not yet been brought into contact with the contact substrate 6 of a liquid container 3 yet and FIG. 5B illustrates a state where the contact springs 13 of the connector 12 have already been brought into contact with the contact substrate 6. As illustrated in FIGS. 4A and 4B, the connector 12 has an engaging section 12*a*. The engaging section 12*a* is engaged with the housing 14 of the liquid ejection head so as to be movable in the axial direction B of the contact springs 13. More specifically, the engaging section 12*a* is engaged with the housing 14 in a state where the contact springs 13 have not yet been brought into contact with the contact substrate 6 (see FIG. 4A). As a result, the connector 12 would not come off from the housing 14. On the other hand, the engaging section 12*a* is separated from the housing 14 in a state where the contact springs 13 have already been brought into contact with the contact substrate 6 (see FIG. 4B).

With a connector 12 having a snap fit joint structure as described above, the front end section 13*a* of each of the contact springs 13 can scrape off the oxidized area, if any, of the contact substrate 6 that corresponds to the contact spring 13 as the front end section 13*a* of the contact spring 13 is pressed and displaced by the contact substrate 6. Therefore, the electrical connection between the contact substrate 6 and the contact springs is made reliable.

Additionally the contact springs 13 of a connector 12 having a snap fit joint structure represent a large stroke in the axial direction B of the contact springs 13 if compared with the contact springs 13 of a connector 12 that is fixed to the housing 14. Therefore, when a liquid container 3 is loaded in the liquid ejection head 1 and the connector having a snap fit joint structure is arranged in the liquid ejection head to correspond to the liquid container 3, each of the contact springs 13 of the connector can exert strong resilient force to the contact point between the front end section 13*a* of the spring contact 13 and the contact substrate 6 of the liquid container 3 if compared with a connector 12 that does not have any snap fit joint structure. Then, as a result, the contact substrate 6 contacts the contact springs 13 of the connector 12 having a snap fit structure with stronger force if compared with a connector that does not have any snap fit joint structure so that the oxidized area, if any, of the contact substrate 6 can advantageously be scraped off to make the electrical contact between the liquid ejection head 1 and the liquid container 3 even more reliable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit for Japanese Patent Application No. 2014-112194, filed May 30, 2014, and Japanese Patent Application No. 2015-090381, filed Apr. 27, 2015, which are hereby incorporated by reference herein in their entirety.

What is claimed is:

1. A liquid ejection device comprising:

a liquid ejection head for ejecting liquid; and a liquid container storing liquid to be supplied to the liquid ejection head and adapted to be loaded in the liquid ejection head, the liquid container having a contact substrate arranged on a surface thereof, the contact substrate having a contact surface located close to the liquid ejection head as the liquid container is loaded in the liquid ejection head, the liquid ejection head having a connector arranged at a position located vis-à-vis the contact substrate of the loaded liquid container and a connection substrate electrically connected to the connector, the connector including a contact spring capable of expanding and contracting in an axial direction, the contact spring having a front end section contacting the contact surface of the contact substrate of the loaded liquid container and a rear end section contacting the connection substrate, and the contact surface of the contact substrate being inclined relative to the axial direction of the contact spring so as to displace the front end section of the contact spring along the contact surface while being held in contact with the contact surface during an operation of loading the liquid container in the liquid ejection head.

2. The device according to claim 1, wherein the contact spring is formed so as to be pointed at the front end thereof like a needle.

3. The device according to claim 1, wherein a plurality of liquid containers are loaded in the liquid ejection head and connectors equal in number to that of the liquid containers are arranged to correspond to the respective liquid containers.

4. The device according to claim 1, wherein the liquid ejection head includes a housing having the connection substrate fitted thereto and the connector has an engaging section to be engaged with the housing so as to be movable in the axial direction.

5. The device according to claim 1, wherein the contact spring is formed by a single contact spring and fixed to the connector at a part thereof located between the front end section and the rear end section thereof.

6. The device according to claim 5, wherein the contact spring includes a bent section between the front end section and a fixing section thereof that is fixed to the connector.

7. The device according to claim 6, wherein the connector includes a restricting section for restricting the part of the contact spring located between the front end section and the bent section in terms of displacement.

8. The device according to claim 1, wherein the contact spring is formed by a first contact spring having the front end section and a second contact spring having the rear end section and the first and second contact springs are connected to each other in the connector, a part of each of the first and second contact springs is fixed to the connector.

9. A method of electrically connecting a liquid ejection head for ejecting liquid and a liquid container storing liquid to be supplied to the liquid ejection head after being loaded in the liquid ejection head, the liquid container having a contact substrate arranged on a surface thereof, the contact substrate having a contact surface located close to the liquid ejection head as the liquid container is loaded in the liquid ejection head, the liquid ejection head having a connector arranged at a position located vis-à-vis the contact substrate of the loaded liquid container and a connection substrate electrically connected to the connector, the connector including a contact spring capable of expanding and contracting in an axial direction, the contact spring having a rear end section contacting the connection substrate and a front end section designed to be brought into contact with the contact surface of the contact substrate, the method comprising loading the liquid container by moving the liquid container toward the liquid ejection head while keeping the surface of the contact substrate in a state of being inclined relative to the axial direction of the contact spring so as to displace the front end section of the contact spring along the contact surface while being held in contact with the contact surface.

10. The method according to claim 9, wherein the liquid ejection head includes a housing having the connection substrate fitted thereto and the connector is engaged with the housing so as to be movable in the axial direction.

11. The method according to claim 9, wherein the contact spring is formed by a single contact spring and fixed to the connector at a part thereof located between the front end section and the rear end section thereof.

12. The method according to claim 11, wherein the contact spring includes a bent section between the front end section and a fixing section thereof that is fixed to the connector.

13. The method according to claim 12, wherein the connector includes a restricting section for restricting the part of the contact spring located between the front end section and the bent section in terms of displacement.

14. The method according to claim 9, wherein the contact spring is formed by a first contact spring having the front end section and a second contact spring having the rear end section and the first and second contact springs are connected to each other in the connector, a part of each of the first and second contact springs is fixed to the connector.

15. A liquid ejection head comprising:

a recording element substrate for ejecting liquid;

a mounting section to be loaded with a liquid container; and a connector equipped with a contact spring having a front end section to be brought into contact with a contact substrate provided on the liquid container and a rear end section to be electrically connected to the recording element substrate, the contact spring being capable of expanding and contracting in an axial direction, the axial direction of the contact spring being inclined relative to the direction of loading the liquid container in the mounting section.

16. The liquid ejection head according to claim 15, wherein the contact spring is formed by a single contact spring and fixed to the connector at a part thereof located between the front end section and the rear end section thereof.

17. The liquid ejection head according to claim 15, wherein the contact spring is formed by a first contact spring having the front end section and a second contact spring having the rear end section and the first and second contact springs are connected to each other in the connector, a part of each of the first and second contact springs is fixed to the connector.

18. The liquid ejection head according to claim 15, further comprising a housing having a connection substrate connected to the contact spring, the connector being engaged with the housing so as to be movable in the axial direction.

19. The liquid ejection head according to claim 15, wherein the contact spring includes a bent section between the front end section and a fixing section thereof that is fixed to the connector.

20. The liquid ejection head according to claim 19, wherein the connector includes a restricting section for restricting the part of the contact spring located between the front end section and the bent section in terms of displacement.

* * * * *